US009759467B2

(12) United States Patent
Kimura

(10) Patent No.: US 9,759,467 B2
(45) Date of Patent: Sep. 12, 2017

(54) CRYOPUMP SYSTEM, CRYOGENIC SYSTEM, AND APPARATUS AND METHOD OF CONTROLLING COMPRESSOR UNIT

(71) Applicant: SUMITOMO HEAVY INDUSTRIES, LTD., Tokyo (JP)

(72) Inventor: Toshiyuki Kimura, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 819 days.

(21) Appl. No.: 13/724,092

(22) Filed: Dec. 21, 2012

(65) Prior Publication Data

US 2013/0160468 A1 Jun. 27, 2013

(30) Foreign Application Priority Data

Dec. 27, 2011 (JP) ..... 2011-285356

(51) Int. Cl.

| | |
|---|---|
| ***F25B 40/00*** | (2006.01) |
| ***F25B 9/00*** | (2006.01) |
| ***F25B 49/02*** | (2006.01) |
| ***F04B 37/08*** | (2006.01) |
| ***F25B 9/14*** | (2006.01) |
| ***F04B 49/08*** | (2006.01) |

(52) U.S. Cl.

CPC ..... *F25B 49/022* (2013.01); *F04B 37/08* (2013.01); *F04B 49/08* (2013.01); *F25B 9/14* (2013.01); *F25B 2400/075* (2013.01)

(58) Field of Classification Search

CPC ..... F25B 2600/02; F25B 2600/027; F25B 2600/0271; F25B 2600/0272; F25B 2600/0253; F25B 49/022; F25B 2700/193; F25B 2700/1931; F25B 2700/1933; F25B 49/025

See application file for complete search history.

(56) References Cited

U.S. PATENT DOCUMENTS

2002/0020175 A1* 2/2002 Street et al. ..... 62/132
2003/0230102 A1* 12/2003 Hong ..... F25B 13/00 62/228.3

(Continued)

FOREIGN PATENT DOCUMENTS

JP H11-211262 A 8/1999
JP 2004-003792 A 1/2004

(Continued)

*Primary Examiner* — Adam J Eiseman
*Assistant Examiner* — Erik Mendoza-Wilkenfe
(74) *Attorney, Agent, or Firm* — Michael Best & Friedrich LLP

(57) ABSTRACT

A compressor controller includes: a control amount calculation unit configured to calculate at least two control amounts including a first control amount for controlling a first control object that relates to a gas amount for cooling a cryogenic apparatus, and a second control amount for controlling a second control object that relates to the refrigerant gas amount and that is different from the first control object, the second control amount being common with the first control amount; and a selection unit configured to select a control object to be controlled from at least two control objects including the first control object and the second control object on the basis of a comparison between the at least two common control amounts.

3 Claims, 7 Drawing Sheets

(56) References Cited

U.S. PATENT DOCUMENTS

| | | | | |
|---|---|---|---|---|
| 2005/0123409 | A1* | 6/2005 | Ota et al. | 417/222.2 |
| 2005/0247073 | A1* | 11/2005 | Hikawa et al. | 62/228.1 |
| 2006/0101836 | A1* | 5/2006 | Tanaka | 62/228.1 |
| 2007/0144190 | A1* | 6/2007 | Temmyo | F25D 29/00 62/180 |
| 2010/0175401 | A1* | 7/2010 | Taguchi | F04B 27/1804 62/228.3 |
| 2010/0186427 | A1 | 7/2010 | Okada et al. | |
| 2011/0219797 | A1* | 9/2011 | Taguchi | 62/129 |
| 2013/0264044 | A1* | 10/2013 | Kearney | F28F 27/00 165/200 |

FOREIGN PATENT DOCUMENTS

| | | | |
|---|---|---|---|
| JP | 2009-007945 | A | 1/2009 |
| WO | WO-2009/028450 | A1 | 3/2009 |

* cited by examiner

CRYOPUMP SYSTEM, CRYOGENIC SYSTEM, AND APPARATUS AND METHOD OF CONTROLLING COMPRESSOR UNIT

BACKGROUND OF THE INVENTION

1. Field of the Invention

The present invention relates to a cryopump system, a cryogenic system, and an apparatus and a method of controlling a compressor unit.

2. Description of the Related Art

A cryogenic system comprising a cryogenic refrigerator and a compressor unit operative to supply refrigerant gas (operating gas) to the refrigerator is known. A system comprising a cryogenic apparatus (e.g., a cryopump) that utilizes a cryogenic refrigerator as a cooling source is also known as an example of a cryogenic system. In a cryogenic system, a compressor unit is sometimes controlled so that a differential pressure of refrigerant gas between a high pressure side and a low pressure side of a refrigerator is in agreement with a defined value. Such differential pressure stabilization control of a compressor unit contributes to reduction of power consumption of a system.

SUMMARY OF THE INVENTION

According to an embodiment of the present invention, a cryopump system is provided. The cryopump system includes: a cryopump including a cryopanel and a refrigerator operative to cool the cryopanel; a compressor unit operative to supply refrigerant gas to the refrigerator; and a control unit configured to selectively perform one of at least two types of operation control for the compressor unit. A common control amount is used in the at least two types of operation control. The at least two types of operation control include first operation control that operates the compressor unit by using the common control amount so as to control a first control object relating to a gas amount to be supplied, and second operation control that operates the compressor unit by using the common control amount so as to control a second control object that relates to a gas amount to be supplied and that is different from the first control object. The control unit selects operation control to be performed from the at least two types of operation control on the basis of a comparison between at least two values of the common control amount including a value of the common control amount for the first operation control and a value of the common control amount for the second operation control.

According to an embodiment of the present invention, a cryogenic system is provided. The cryogenic system includes: at least one cryogenic refrigerator; at least one compressor unit operative to supply refrigerant gas to the at least one cryogenic refrigerator; and a control unit configured to selectively perform one of at least two types of control for the compressor unit on the basis of a common evaluation parameter for evaluating operation status of each of the at least two types of control.

According to an embodiment of the present invention, a controller of a compressor unit for supplying refrigerant gas for cooling a cryogenic apparatus to the cryogenic apparatus is provided. The controller includes: a control amount calculation unit configured to calculate at least two control amounts including a first control amount for controlling a first control object that relates to a gas amount to be supplied from the compressor unit to the cryogenic apparatus and a second control amount for controlling a second control object that relates to the gas amount to be supplied and that is different from the first control object, the second control amount being common with the first control amount; and a selection unit configured to select a control object to be controlled from at least two control objects including the first control object and the second control object on the basis of a comparison between the at least two control amounts.

According to an embodiment of the present invention, a method of controlling a compressor unit for supplying refrigerant gas for cooling a cryogenic apparatus to the cryogenic apparatus is provided. The method includes: determining whether or not normal control of the compressor unit puts a heavier load on the compressor unit than protection control for the compressor unit; and changing control to the protection control in case of determining that the normal control puts a heavier load on the compressor unit than the protection control.

Optional combinations of the aforementioned constituting elements, and implementations of the invention in the form of methods, apparatuses, systems, programs, or the like may also be practiced as additional modes of the present invention.

DETAILED DESCRIPTION OF THE INVENTION

Figure 1:
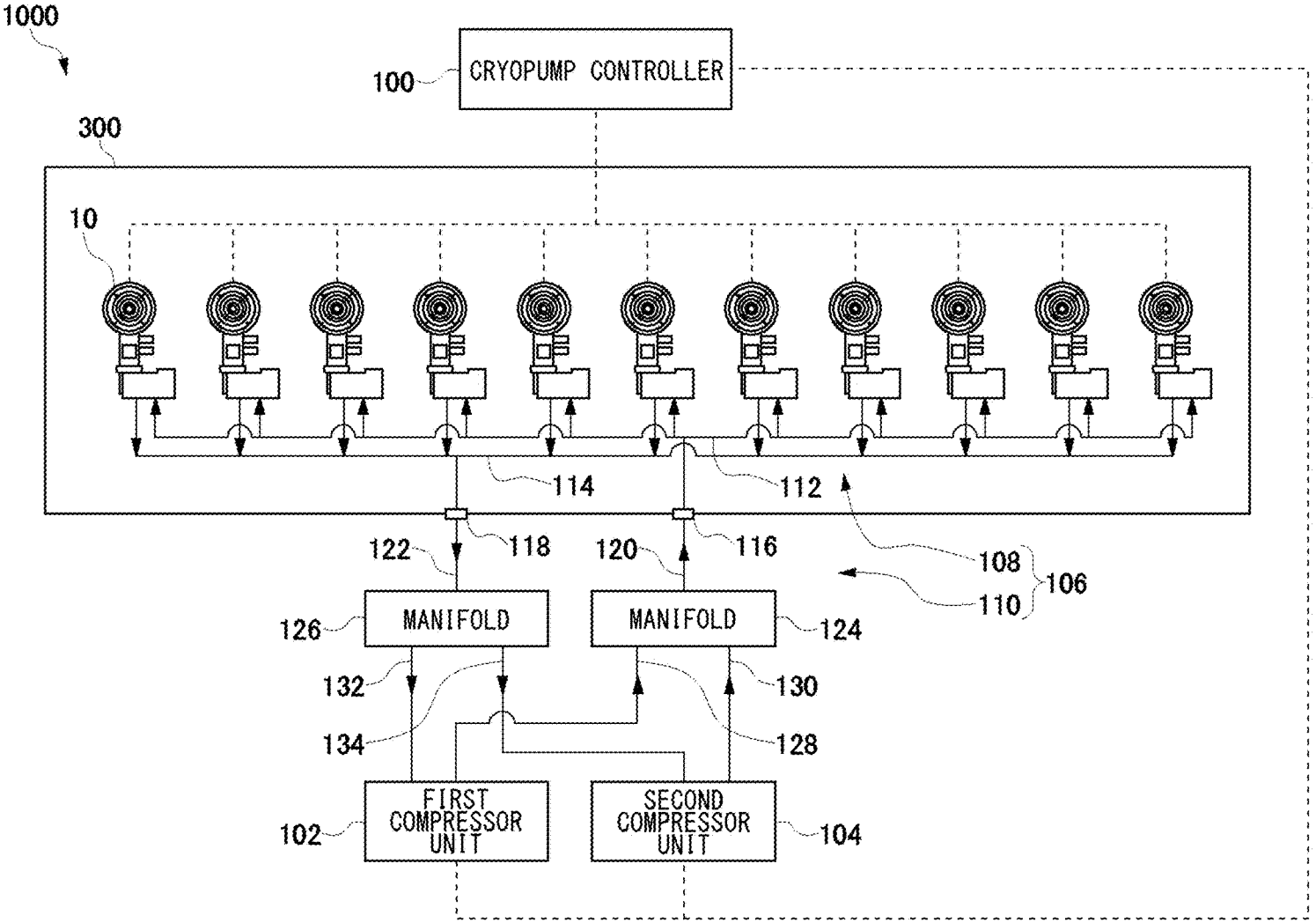
FIG. 1 schematically shows the entire structure of a cryopump system according to an exemplary embodiment of the present invention.

The invention will now be described by reference to the preferred embodiments. This does not intend to limit the scope of the present invention, but to exemplify the invention.

Recently, providing high energy saving performance is one of the most important requirements for a cryopump system or a cryogenic system. Differential pressure stabilization control of a compressor unit is one of the useful technologies to satisfy the requirement.

On the other hand, improvement in basic performance such as, cooling capability, continuity of operation, or the like is also required while providing high energy saving performance. For example in a system provided with a certain refrigerator, one measure to improve the cooling capability without changing the design of the refrigerator is to increase the enclosure pressure of refrigerant gas in the compressor unit. Alternatively, in case of performing the differential pressure stabilization control, the cooling capability can be improved by defining a higher differential pressure as a set value.

In most of compressor units, a configuration for warning of a departure from an operation range according to the specification of the compressor unit is provided in advance. For example, a high pressure set value to warn of an excessive high pressure of refrigerant gas is determined electronically or mechanically. As a result of improving the cooling capability of the refrigerator by the aforementioned measure, the probability increases that a refrigerant gas pressure reaches to the high pressure set value during operation of the system. Some compressor units are configured so as to change an operation status of the compressor unit in a discontinuous manner in order to control a refrigerant gas pressure that the gas pressure does not to surpass the high pressure set value. Sometimes, a compressor unit stops automatically when a refrigerant gas pressure reaches the high pressure set value. The suspension of operation of compressor unit significantly changes the status of the system for certain.

It is important to stabilize a cooling temperature in a cryogenic apparatus. For example in case of a cryopump, a stability of the temperature of a cryopanel is required in order to provide the function of the pump continuously. An abrupt change in operation status including a sudden suspension of a compressor unit in a cryogenic system might cause a negative impact on the stability of a cooling temperature.

One of exemplary purposes of an embodiment of the present invention is to provide control that can contribute to operational continuity of a system in relation with a compressor unit for a cryogenic system.

The cryopump system according to an embodiment of the present invention includes: a cryopump including a cryopanel and a refrigerator operative to cool the cryopanel; a compressor unit operative to supply refrigerant gas to the refrigerator; and a control unit configured to selectively perform one of at least two types of operation control for the compressor unit. A common control amount is used in the at least two types of operation control. The at least two types of operation control include first operation control that operates the compressor unit by using the common control amount so as to control a first control object relating to a gas amount to be supplied, and second operation control that operates the compressor unit by using the common control amount so as to control a second control object that relates to a gas amount to be supplied and that is different from the first control object. The control unit selects operation control to be performed from the at least two types of operation control on the basis of a comparison between at least two values of the common control amount including a value of the common control amount for the first operation control and a value of the common control amount for the second operation control.

A control amount of operation control can be considered as a parameter that deeply reflects the operation status of the compressor unit as a result of control process based on the control amount. When control is changed from one type to another, the operation status of the compressor unit is changed in accordance with the magnitude of the change of control amount between before and after the change of control. For example, when changing from a first operation control to a second operation control, if a difference between control amounts of two types of operation control is large, the operation status of the compressor unit also changes significantly. Therefore, an impact on the operation status caused by the change can be evaluated by comparing respective control amounts. In this manner, operation control being appropriate in terms of operational continuity of the system can be selected from at least two types of compressor unit operation control and can be performed in order to supply refrigerant gas of required amount to a refrigerator and to cool a cryopump to a desired level. For example, whether to continue current operation control or to change to another operation control can be determined from the view point of operational continuity of a cryogenic system with stability.

The first operation control may be operation control that is currently selected and the second operation control may be one of one or more types of operation control that are not currently selected. The control unit may switch the first operation control to the second operation control in case the magnitude relation between the value of a common control amount for the first operation control and the value of a common control amount for the second operation control is changed.

The change of magnitude relation between the control amounts for respective operation control can be considered to be associated with a change of the status of the compressor unit. Further, it is expected that one control amount value is slightly larger than the other immediately before the change of magnitude relation, and the one control amount value is slightly smaller than the other immediately after the change of magnitude relation. In this case, change in control amount resulted from changing from current operation control to another operation control along with the change in the magnitude relation will be small. Therefore, setting the change in the magnitude relation as a trigger for the change of operation control can avoid abrupt change in the operation status of the compressor unit when changing control.

The first operation control may be operation control that is normally selected, and the second operation control may be compressor protection control wherein the common control amount is determined on the basis of a deviation between the second control object and a target value defined for the second control object in order to protect the compressor unit.

In this case, determination as to whether or not to switch operation control can be made by considering an effect on the operation status of a compressor unit due to the switch between the normal operation control and the protection control of the compressor unit. For example, an abrupt change of operation resulted from switching operation for protection can be avoided.

The first control object may be a differential pressure between a supply side pressure and a return side pressure of the compressor unit, and the first operation control may be differential pressure control wherein the common control amount is determined on the basis of a deviation between the differential pressure and a target value for the differential pressure. The second control object may be the supply side pressure of the compressor unit, and the second operation control may be supply pressure control wherein the common control amount is determined on the basis of a deviation between the supply side pressure and a target value for the supply side pressure.

The differential pressure control is effective at reducing the power consumption of a cryogenic system. Further, the supply pressure control is effective as an example of compressor protection control for restricting an excessive high pressure since the supply pressure control can keep a supply side pressure in the vicinity of a target value.

The at least two types of operation control may further include a third operation control that operates the compressor unit by using a common control amount so as to control a third control object relating to a gas amount to be supplied.

The control unit may select operation control to be performed from the at least two types of operation control on the basis of at least three values of the common control amount including the value of the common control amount for the first operation control, the value of the common control amount for the second operation control, and a value of the common control amount for the third operation control. The third control object may be a return side pressure of the compressor unit, and the third operation control may be return pressure control wherein the common control amount is determined on the basis of a deviation between the return side pressure and a target value for the return side pressure.

By arranging the third operation control in addition to the first operation control and the second operation control, more appropriate operation control can be selected depending on statuses.

According to another aspect of the present invention, a cryogenic system is provided. The cryogenic system includes: at least one cryogenic refrigerator; at least one compressor unit operative to supply refrigerant gas to the at least one cryogenic refrigerator; and a control unit configured to selectively perform one of at least two types of control for the compressor unit on the basis of a common evaluation parameter for evaluating operation status of each of the at least two types of control. According to the aspect of the invention, influences on operation status caused by respective control can be readily compared, since the common evaluation parameter for evaluating operation status is used. Based on the comparison result, control of the compressor unit can be selected and performed.

The at least one compressor unit may comprise a plurality of compressor units. The control unit may perform the selection of the at least two types of control individually for each of the plurality of compressor units. In this manner, control appropriate to each of a plurality of compressor units of a cryogenic system can be selected without depending on operation status of other compressor unit.

According to another aspect of the present invention, a controller for a compressor unit is provided. The apparatus is a control apparatus of a compressor unit for supplying refrigerant gas for cooling a cryogenic apparatus to the cryogenic apparatus. The control apparatus includes: a control amount calculation unit configured to calculate at least two control amounts including a first control amount for controlling a first control object that relates to a gas amount to be supplied from the compressor unit to the cryogenic apparatus and a second control amount for controlling a second control object that relates to the gas amount to be supplied and that is different from the first control object, the second control amount being common with the first control amount; and a selection unit configured to select a control object to be controlled from at least two control objects including the first control object and the second control object on the basis of a comparison between the at least two control amounts.

According to another aspect of the present invention, a method of controlling a compressor unit is provided. This method is a method for controlling a compressor unit for supplying refrigerant gas for cooling a cryogenic apparatus to the cryogenic apparatus. The method includes: determining whether or not normal control of the compressor unit puts a heavier load on the compressor unit than protection control for the compressor unit; and changing control to the protection control in case of determining that the normal control puts a heavier load on the compressor unit than the protection control. According to the aspect of the invention, in case that the normal control of a compressor unit puts heavy load to the compressor unit, the normal control can be changed to the protection control. In this manner, the operation can be continued while protecting the compressor unit.

The method may include returning control from the protection control to the normal control in case of determining during the protection control that the protection control puts a heavier load on the compressor unit than the normal control. In this manner, in case that the continuation protection control has the opposite effect that resulted in putting heavy load to the compressor unit, the protection control can be turned back to the normal control.

FIG. 1 schematically shows the entire structure of a cryopump system 1000 according to an exemplary embodiment of the present invention. The cryopump system 1000 is used for vacuum-pumping a vacuum apparatus 300. The vacuum apparatus 300 is a vacuum processing apparatus that processes an object in a vacuum environment, for example an apparatus used at a semiconductor manufacturing process such as, an ion implantation apparatus, a sputtering apparatus, or the like.

The cryopump system 1000 includes a plurality of cryopumps 10. These cryopumps 10 are mounted to one or more vacuum chambers (not shown) of the vacuum apparatus 300 and used to increase the vacuum level inside the vacuum chamber to a level required by a desired process. The cryopump 10 is operated in accordance with a control amount determined by a cryopump controller 100 (herein after, also referred to as a CP controller). A high level vacuum, for example, $10^{-5}$ Pa to $10^{-8}$ Pa is realized in the vacuum chamber. In an example shown in the figure, eleven cryopumps 10 are included in the cryopump system 1000. The plurality of cryopumps 10 may have the same vacuum pumping performance, or may have different vacuum pumping performances.

The cryopump system 1000 comprises a CP controller 100. The CP controller 100 controls a cryopump 10, and compressor units 102 and 104. The CP controller 100 comprises a CPU that executes various types of arithmetic computing processes, a ROM that stores various types of control programs, a RAM that is used as a work area for storing data or executing a program, an I/O interface, a memory, or the like. The CP controller 100 is configured to be able to communicate with a host controller (not shown) for controlling the vacuum apparatus 300. The host controller of the vacuum apparatus 300 may also be referred to as an upper level controller that integrally controls respective constituent elements of the vacuum apparatus 300 including the cryopump system 1000.

The cryopump system 1000 is configured in a separate body from the cryopump 10, and the compressor units 102 and 104. The CP controller 100 is communicably connected with the cryopump 10 and the compressor units 102 and 104. Each cryopump 10 comprises an I/O module 50 (cf. FIG. 4) that performs an input/output processing for a communication with the CP controller 100. The CP controller 100 and respective I/O modules 50 are connected with each other by a control communication line. In FIG. 1, the control communication line between the cryopump 10 and the CP controller 100, and the control communication line between the compressor units 102 and 104 and the CP controller 100 are indicated with dashed lines. The CP controller 100 may be integrally mounted with one of the cryopumps 10 or the compressor units 102 or 104.

The CP controller 100 may be configured with a single controller, or may be configured so as to include a plurality of controllers, each of which performs a same function as or a different function from another one. For example, the CP controller 100 may comprise a compressor controller that is provided in each compressor unit and determines a control amount for each compressor unit, and a cryopump controller that integrally controls the cryopump system.

The cryopump system 1000 comprises a plurality of compressor units that includes at least the first compressor unit 102 and the second compressor unit 104. The compressor units are provided to circulate refrigerant gas through a closed fluid circuit including the cryopumps 10. The compressor unit collects the refrigerant gas from the cryopump 10 and compresses the refrigerant gas. The compressor unit then delivers the refrigerant gas again to the cryopumps 10. The compressor unit is installed apart from the vacuum apparatus 300, or in proximity to the vacuum apparatus 300. The compressor unit is operated in accordance with a control amount determined by a compressor controller 168 (cf. FIG. 4). Alternatively, the compressor unit is operated in accordance with a control amount determined by the CP controller 100.

Although an explanation will be given below on the cryopump system 1000 having two compressor units 102 and 104 as a representative example, the present invention is not limited thereto. In a similar manner with that of the compressor units 102 and 104, the cryopump system 1000 may be configured so that more than two compressor units are connect in parallel to a plurality of cryopumps 10. Although the cryopump system 1000 shown in FIG. 1 comprises a plurality of cryopumps 10 and a plurality of compressor units 102 and 104, the number of cryopumps 10, or the number of compressor units 102 and 104 may be one.

The plurality of cryopumps 10 and the plurality of compressor units 102 and 104 are connected by a refrigerant gas piping system 106. The piping system 106 connects the plurality of cryopumps 10 and the plurality of compressor units 102 and 104 in parallel among each other. The piping system 106 is configured so as to allow refrigerant gas to flow between the plurality of cryopumps 10 and the plurality of compressor units 102 and 104. By the piping system 106, a plurality of compressor units are connected to one cryopump 10 in parallel, respectively, and a plurality of cryopumps 10 are connected to one compressor unit in parallel, respectively.

The piping system 106 is configured to include interior piping 108 and exterior piping 110. The interior piping 108 is formed inside of the vacuum apparatus 300 and includes an interior supply line 112 and an interior return line 114. The exterior piping 110 is installed outside of the vacuum apparatus 300, and includes an exterior supply line 120 and an exterior return line 122. The exterior piping 110 connects between the vacuum apparatus 300 and the plurality of compressor units 102 and 104.

Figure 2:
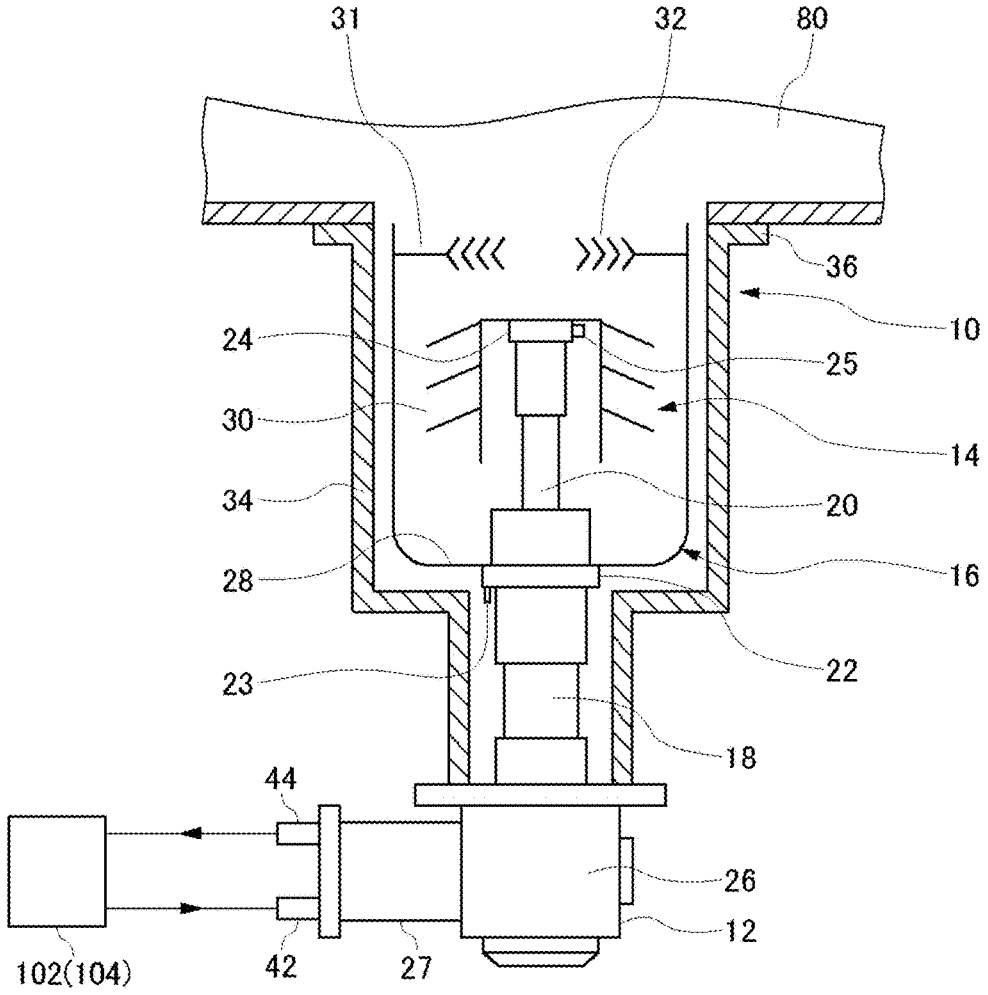
FIG. 2 schematically shows a cross-sectional view of a cryopump according to an exemplary embodiment of the present invention.

The interior supply line 112 is connected to a gas inlet 42 of respective cryopumps 10 (cf. FIG. 2), and the interior return line 114 is connected to a gas outlet 44 of respective cryopumps 10 (cf. FIG. 2). The interior supply line 112 is connected to one end of the exterior supply line 120 of the exterior piping 110 by a gas supply port 116 of the vacuum apparatus 300. The interior return line 114 is connected to one end of the exterior return line 122 of the exterior piping 110 by a gas return port 118 of the vacuum apparatus 300.

The other end of the exterior supply line 120 is connected to a first manifold 124, and the other end of the exterior return line 122 is connected to a second manifold 126. To the first manifold 124 are connected one end of a first supply pipe 128 of the first compressor unit 102 and one end of a second supply pipe 130 of the second compressor unit 104. The other ends of the first supply pipe 128 and the second supply pipe 130 are connected to the supply ports 148 of corresponding compressor units 102 and 104, respectively (cf. FIG. 3). To the second manifold 126 are connected one end of a first return pipe 132 of the first compressor unit 102 and one end of a second return pipe 134 of the second compressor unit 104. The other ends of the first return pipe 132 and the second return pipe 134 are connected to return ports 146 of corresponding compressor units 102 and 104, respectively (cf. FIG. 3).

In this way, a shared supply line for collecting refrigerant gas delivered from the plurality of compressor units 102 and 104 respectively, and for supplying refrigerant gas to the plurality of cryopumps 10 is configured by the interior supply line 112 and the exterior supply line 120. Further, a shared return line for collecting refrigerant gas exhausted from the plurality of cryopumps 10 and for returning the refrigerant gas to the plurality of compressor units 102 and 104 is configured by the interior return line 114 and the exterior return line 122. Each of the plurality of compressor units are connected to the shared line through a separate pipe attached to each of the compressor units. At a joint portion of the separate pipes and the shared line, a manifold for merging the separate pipes is provided. The first manifold 124 merges the separate pipes at a supplying side and the second manifold 126 merges the separate pipes at a collecting side.

The aforementioned shared line may be considerably long (different from the figure), depending on the lay-out of various types of apparatuses at a location where the cryopump system 1000 is used (e.g., semiconductor manufacturing plant). By collecting refrigerant gas to the shared line, the total length of pipes can be shortened in comparison with the case where each of a plurality of compressors are separately connected to a vacuum apparatus. Further, since the pipe arrangement is configured so that a plurality of compressors are connected to respective supply targets of refrigerant gas (e.g., respective cryopumps 10 in the cryopump system 1000), the pipe arrangement also has redundancy. By arranging a plurality of compressors to respective targets (e.g., cryopumps) in parallel and operating the compressors in parallel, the load to the plurality of compressors are shared by the compressors.

FIG. 2 schematically shows a cross-sectional view of a cryopump 10 according to an exemplary embodiment of the present invention. The cryopump 10 comprises a first cryopanel cooled to a first cooling temperature level and a second cryopanel cooled to a second cooling temperature level lower than the first cooling temperature level. The first cryopanel condenses and captures a gas having a sufficiently-low vapor pressure at the first cooling temperature level so as to pump out the gas accordingly. For example, the first cryopanel pumps out a gas having a vapor pressure lower than a reference vapor pressure (e.g., $10^{-8}$ Pa). The second cryopanel condenses and captures a gas having a sufficiently-low vapor pressure at the second cooling temperature level so as to pump out the gas accordingly. In order to capture a non-condensible gas that is not condensed even at the second temperature level due to its high vapor pressure, an adsorption area is formed on the surface of the second cryopanel. The adsorption area is formed by, for example, providing an adsorbent on the panel surface. A non-condensible gas is adsorbed by the adsorption area cooled to the second temperature level and pumped out, accordingly.

The cryopump 10 shown in FIG. 2 comprises a refrigerator 12, a panel assembly 14 and a heat shield 16. The refrigerator 12 cools by a thermal cycle wherein the refrigerator 12 intakes refrigerant gas, expands the gas inside of the refrigerator, and discharges the gas, accordingly. The panel assembly 14 includes a plurality of cryopanels, which are cooled by the refrigerator 12. A cryogenic temperature surface for capturing a gas by condensation or adsorption so as to pump out the gas, is formed on the panel surface. The surface (e.g., rear face) of the cryopanel is normally provided with an adsorbent such as charcoal or the like in order to adsorb a gas. The heat shield 16 is provided in order to protect the panel assembly 14 from ambient radiation heat.

The cryopump 10 is a so-called vertical-type cryopump, where the refrigerator 12 is inserted and arranged along the axial direction of the heat shield 16. The present invention is also applicable to a so-called horizontal-type cryopump in a similar manner, where the second cooling stage of the refrigerator is inserted and arranged along the direction that intersects (usually orthogonally) with the axis of the heat shield 16. FIG. 1 schematically shows a horizontal-type cryopump 10.

The refrigerator 12 is a Gifford-McMahon refrigerator (so-called GM refrigerator). The refrigerator 12 is a two-stage refrigerator comprising a first cylinder 18, a second cylinder 20, a first cooling stage 22, a second cooling stage 24 and a refrigerator motor 26. The first cylinder 18 and the second cylinder 20 are connected in series, in which a first displacer and a second displacer (not shown) coupled with each other are contained, respectively. A regenerator is incorporated into the first displacer and the second displacer. The refrigerator 12 may be a refrigerator other than the two-stage GM refrigerator. For example, a single-stage GM refrigerator may be used, or a pulse tube refrigerator or a Solvay refrigerator may be used.

In order to periodically repeat intake and discharge of the refrigerant gas, the refrigerator 12 includes a passage switching mechanism that periodically switches passages for the refrigerant gas. The passage switching mechanism includes, for example, a valve unit and a drive unit that drives the valve unit. The valve unit is, for example, a rotary valve and the drive unit is a motor for rotating the rotary valve. The motor may be, for example, an AC motor or a DC motor. The passage switching mechanism may be a mechanism of a direct-drive type, which may be driven by a linear motor.

The refrigerator motor 26 is provided at one end of the first cylinder 18. The refrigerator motor 26 is provided inside a motor housing 27 formed at the end portion of the first cylinder 18. The refrigerator motor 26 is connected to the first displacer and the second displacer so that the first displacer and the second displacer can reciprocally move inside the first cylinder 18 and the second cylinder 20, respectively. The refrigerator motor 26 is connected to a movable valve (not shown) provided inside the motor housing 27 so that the valve can be positively/negatively rotated.

The first cooling stage 22 is provided at the end portion of the first cylinder 18 on the second cylinder 20 side, i.e., at the portion connecting the first cylinder 18 and the second cylinder 20. The second cooling stage 24 is provided at the tail end of the second cylinder 20. The first cooling stage 22 and the second cooling stage 24 are fixed to the first cylinder 18 and the second cylinder 20, respectively, for example by brazing.

The refrigerator 12 is connected to the first compressor unit 102 or the second compressor unit 104 through the gas inlet 42 and the gas outlet 44 provided outside of the motor housing 27. The cryopump 10, and the first compressor unit 102 and the second compressor unit 104 are connected with each other as explained with reference to FIG. 1.

The refrigerator 12 expands a high pressure refrigerant gas (e.g., helium) supplied from the compressor units 102 and 104 so as to cool the first cooling stage 22 and the second cooling stage 24. The compressor unit 102 or 104 collects the refrigerant gas expanded inside the refrigerator 12 and repressurizes the gas and supply the gas to the refrigerator 12, accordingly.

Specifically, a high pressure refrigerant gas is first supplied to the refrigerator 12 from the compressor unit 102 or 104. In this process, the refrigerator motor 26 drives the movable valve inside the motor housing 27 so that the gas inlet 42 and the inside space of the refrigerator 12 are connected with each other. When the inside space of the refrigerator 12 is filled with refrigerant gas with a high pressure, the refrigerator motor 26 switches the movable valve, and the inside space of the refrigerator 12 is connected to the gas outlet 44, accordingly. Thereby, the refrigerant gas is expanded and returned to the compressor unit 102 or 104. In synchronization with the operation of the movable valve, the first displacer and the second displacer reciprocally move inside the first cylinder 18 and the second cylinder 20, respectively. By repeating such heat cycles, the refrigerator 12 generates cold states in the first cooling stage 22 and the second cooling stage 24.

The second cooling stage 24 is cooled to a temperature lower than that of the first cooling stage 22. The second cooling stage 24 is cooled to, for example, approximately 10 K to 20 K, while the first cooling stage is cooled to, for example, approximately 80 K to 100 K. A first temperature sensor 23 is mounted on the first cooling stage 22 in order to measure a temperature thereof, and a second temperature sensor 25 is mounted on the second cooling stage 24 in order to measure a temperature thereof.

The heat shield 16 is fixed and thermally connected to the first cooling stage 22 of the refrigerator 12, while the panel assembly 14 is fixed and thermally connected to the second cooling stage 24 of the refrigerator 12. Thereby, the heat shield 16 is cooled to a temperature approximately equal to that of the first cooling stage 22, while the panel assembly 14 is cooled to a temperature approximately equal to that of the second cooling stage 24. The heat shield 16 is formed into a cylindrical shape having an opening 31 at one end thereof. The opening 31 is defined by the interior surface at the end of the cylindrical side face of the heat shield 16.

On the other hand, on the side opposite to the opening 31, i.e., at the other end on the pump bottom side, of the heat shield 16, a closed portion 28 is formed. The closed portion 28 is formed by a flange portion extending in an inward radial direction at the end portion of the pump bottom side of the cylindrical side face of the heat shield 16. As the cryopump 10 shown in FIG. 2 is a vertical-type cryopump, the flange portion is mounted to the first cooling stage 22 of the refrigerator 12. Thereby, a cylindrically-shaped inside space 30 is formed within the heat shield 16. The refrigerator 12 protrudes into the inside space 30 along the central axis of the heat shield 16, and the second cooling stage 24 is inserted in the inside space 30.

In case of a horizontal-type cryopump, the closed portion 28 is usually closed completely. The refrigerator 12 is arranged so as to protrude into the inside space 30 along a direction orthogonal to the central axis of the heat shield 16 from an opening for attaching the refrigerator, formed on the side face of the heat shield 16. The first cooling stage 22 of the refrigerator 12 is mounted to the heat shield 16 at the opening for attaching the refrigerator, while the second cooling stage 24 of the refrigerator 12 is arranged in the inside space 30. On the second cooling stage 24, the panel assembly 14 is mounted. Therefore, the panel assembly 14 is arranged in the inside space 30 of the heat shield 16. Alternatively, the panel assembly 14 may be mounted to the second cooling stage 24 via an appropriately-shaped panel mounting member.

A baffle 32 is provided at the opening 31 of the heat shield 16. The baffle 32 is provided at a position spaced apart from the panel assembly 14 in the direction of the central axis of the heat shield 16. The baffle 32 is mounted in the end portion on the opening 31 side of the heat shield 16, and is cooled to a temperature approximately equal to that of the heat shield 16. The baffle 32 may be formed, for example, in a concentric arrangement, or into other shapes such as a lattice shape, etc., when viewed from the vacuum chamber 80 side. A gate valve (not shown) is provided between the baffle 32 and the vacuum chamber 80. The gate valve is, for example, closed when the cryopump 10 is regenerated, and opened when the vacuum chamber 80 is evacuated by the cryopump 10. The vacuum chamber 80 is provided, for example in the vacuum apparatus 300 shown in FIG. 1.

The heat shield 16, the baffle 32, the panel assembly 14, and the first cooling stage 22 and the second cooling stage 24 of the refrigerator 12, are contained inside the pump housing 34. The pump housing 34 is formed by connecting two cylinders in series, diameters of cylinders being different from each other. The end portion of the cylinder with a larger diameter of the pump housing 34 is opened, and a flange portion 36 for connection with the vacuum chamber 80 is formed so as to extend outwardly in the radial direction. The end portion of the cylinder with a smaller diameter of the pump housing 34 is fixed to the motor housing 27 of the refrigerator 12. The cryopump 10 is fixed to an evacuation opening of the vacuum chamber 80 in an airtight manner via the flange portion 36 of the pump housing 34, allowing an airtight space integrated with the inside space of the vacuum chamber 80 to be formed. The pump housing 34 and the heat shield 16 are both formed into cylindrical shapes and arranged concentrically. Because the inner diameter of the pump housing 34 is slightly larger than the outer diameter of the heat shield 16, the heat shield 16 is arranged slightly spaced apart from the interior surface of the pump housing 34.

In operating the cryopump 10, the inside of the vacuum chamber 80 is first roughly evacuated to approximately 1 to 10 Pa by using another appropriate roughing pump before starting the operation. Thereafter, the cryopump 10 is operated. By driving the refrigerator 12, the first cooling stage 22 and the second cooling stage 24 are cooled, thereby the heat shield 16, the baffle 32, and the cryopanel assembly 14, which are thermally connected to the stages, are also cooled.

The cooled baffle 32 cools the gas molecules flowing from the vacuum chamber 80 into the cryopump 10 so that a gas whose vapor pressure is sufficiently low at the cooling temperature (e.g., water vapor or the like) will be condensed on the surface of the baffle 32 and pumped, accordingly. A gas whose vapor pressure is not sufficiently low at the cooling temperature of the baffle 32 enters into the heat shield 16 through the baffle 32. Of the entering gas molecules, a gas whose vapor pressure is sufficiently low at the cooling temperature of the panel assembly 14 (e.g., argon or the like) will be condensed on the surface of the panel assembly 14 and pumped, accordingly. A gas whose vapor pressure is not sufficiently low at the cooling temperature (e.g., hydrogen or the like) is adsorbed by an adsorbent, which is adhered to the surface of the panel assembly 14 and cooled, and the gas is pumped accordingly. In this way, the cryopump 10 can attain a desired degree of vacuum in the vacuum chamber 80.

Figure 3:
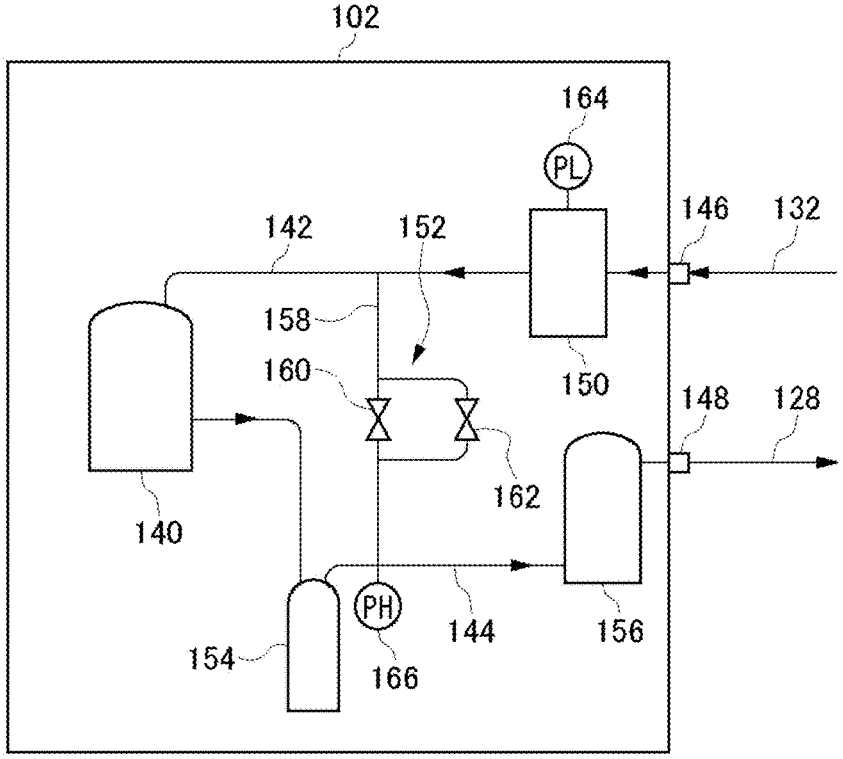
FIG. 3 schematically shows a compressor unit according to an exemplary embodiment of the present invention.

FIG. 3 schematically shows the compressor unit 102 according to an exemplary embodiment of the present invention. According to the exemplary embodiment, the second compressor unit 104 has a similar structure with that of the first compressor unit 102. The first compressor unit 102 is configured to include a compressor main body 140 raising the pressure of gas, a low pressure pipe 142 for supplying low pressure gas supplied from the outside to the compressor main body 140, and a high pressure pipe 144 for delivering high pressure gas compressed by the compressor main body 140 to the outside.

As shown in FIG. 1, low pressure gas is supplied through the first return pipe 132 to the first compressor unit 102. The first compressor unit 102 receives gas returned from the cryopump 10 by the return port 146, and the refrigerant gas is delivered to the low pressure pipe 142, accordingly. The return port 146 is provided on a housing of the first compressor unit 102 at an end of the low pressure pipe 142. The low pressure pipe 142 connects the return port 146 and an intake opening of the compressor main body 140.

The low pressure pipe 142 comprises at its middle a storage tank 150 as a volume for eliminating pulsation included in returned gas. The storage tank 150 is provided between the return port 146 and a branch to a bypass mechanism 152, which will be described below. The refrigerant gas, with which the pulsation is eliminated in the storage tank 150, is supplied through the low pressure pipe 142 to the compressor main body 140. Inside the storage tank 150, a filter for removing unnecessary particles, etc. from gas may be provided. Between the storage tank 150 and the return port 146, a receiving port and a pipe that are provided for replenishing refrigerant gas from the outside may be connected.

The compressor main body 140 is, for example, a scroll pump or a rotary pump, and performs a function of raising the pressure of gas taken in. The compressor main body 140 sends the pressurized refrigerant gas to the high pressure pipe 144. The compressor main body 140 is configured to be cooled with oil, and an oil cooling pipe that circulates oil is provided in association with the compressor main body 140. Thereby, the pressurized refrigerant gas is sent to the high pressure pipe 144, while the oil is mixed in with the refrigerant gas to some extent.

Therefore, at the middle of the high pressure pipe 144, an oil separator 154 is provided. Oil separated from refrigerant gas by the oil separator 154 may be returned to the low pressure pipe 142, and may be returned to the compressor main body 140 through the low pressure pipe 142. A relief valve for releasing excessive high pressure gas may be provided in the oil separator 154.

At the middle of the high pressure pipe 144 that connects the compressor main body 140 and the oil separator 154, a heat exchanger for cooling high pressure refrigerant gas delivered from the compressor main body 140 may be provided (not shown). The heat exchanger cools the refrigerant gas by, for example, coolant water. The coolant water may also be used for cooling the oil that cools the compressor main body 140. On the high pressure pipe 144, at least one of the upstream or the downstream of the heat exchanger, a temperature sensor for measuring the temperature of the refrigerant gas may be provided.

The refrigerant gas that has passed through the oil separator 154 is sent to an adsorber 156 through the high pressure pipe 144. The adsorber 156 is provided for removing from refrigerant gas contaminants that have not been removed by contaminant removing means provided on a flow passage, such as the filter in the storage tank 150, the oil separator 154, or the like. The adsorber 156 removes, for example, evaporated oil by adsorption.

The supply port 148 is provided on the housing of the first compressor unit 102 at an end of the high pressure pipe 144. That is, the high pressure pipe 144 connects between the compressor main body 140 and the supply port 148, and at the middle thereof, the oil separator 154 and the adsorber 156 are provided. The refrigerant gas that has passed through the adsorber 156 is delivered to the cryopump 10 through the supply port 148.

The first compressor unit 102 comprises the bypass mechanism 152 provided with a bypass pipe 158 that connects between the low pressure pipe 142 and the high pressure pipe 144. In the exemplary embodiment shown in the figure, the bypass pipe 158 is branched from the low pressure pipe 142 at a location between the storage tank 150 and the compressor main body 140. Further, the bypass pipe 158 is branched from the high pressure pipe 144 at a location between the oil separator 154 and the adsorber 156.

The bypass mechanism 152 comprises a control valve for controlling the flow rate of refrigerant gas that is not delivered to the cryopump 10 and bypasses from the high pressure pipe 144 to the low pressure pipe 142. In the exemplary embodiment shown in the figure, a first control valve 160 and a second control valve 162 are provided in parallel at the middle of the bypass pipe 158. The first control valve 160 and the second control valve 162 are, for example, a normally-closed type or normally-opened type solenoid valve. According to the exemplary embodiment, the second control valve 162 is used as a flow control valve of the bypass pipe 158. Hereinafter, the second control valve 162 may also be referred to as a relief valve 162.

The first compressor unit 102 comprises a first pressure sensor 164 for measuring the pressure of return gas returned from the cryopump 10 and a second pressure sensor 166 for measuring the pressure of supply gas to be delivered to the cryopump 10. Since the pressure of the supply gas is higher than that of the return gas during the operation of the first compressor unit 102, hereinafter the first pressure sensor 164 and the second pressure sensor 166 may also be referred to as a low pressure sensor and a high pressure sensor, respectively.

The first pressure sensor 164 is provided to measure the pressure of the low pressure pipe 142, and the second pressure sensor 166 is provided to measure the pressure of the high pressure pipe 144. The first pressure sensor 164 is installed, for example in the storage tank 150 and measures the pressure of return gas, of which the pulsation is eliminated in the storage tank 150. The first pressure sensor 164 may be provided at any positions on the low pressure pipe 142. The second pressure sensor 166 is provided between the oil separator 154 and the adsorber 156. The second pressure sensor 166 may be provided at any positions on the high pressure pipe 144.

The first pressure sensor 164 and the second pressure sensor 166 may be provided outside of the first compressor unit 102, for example, may be provided on the first return pipe 132 and the first supply pipe 128. The bypass mechanism 152 may be also provided outside of the first compressor unit 102. For example, the bypass pipe 158 may connect the first return pipe 132 and the first supply pipe 128.

Figure 4:
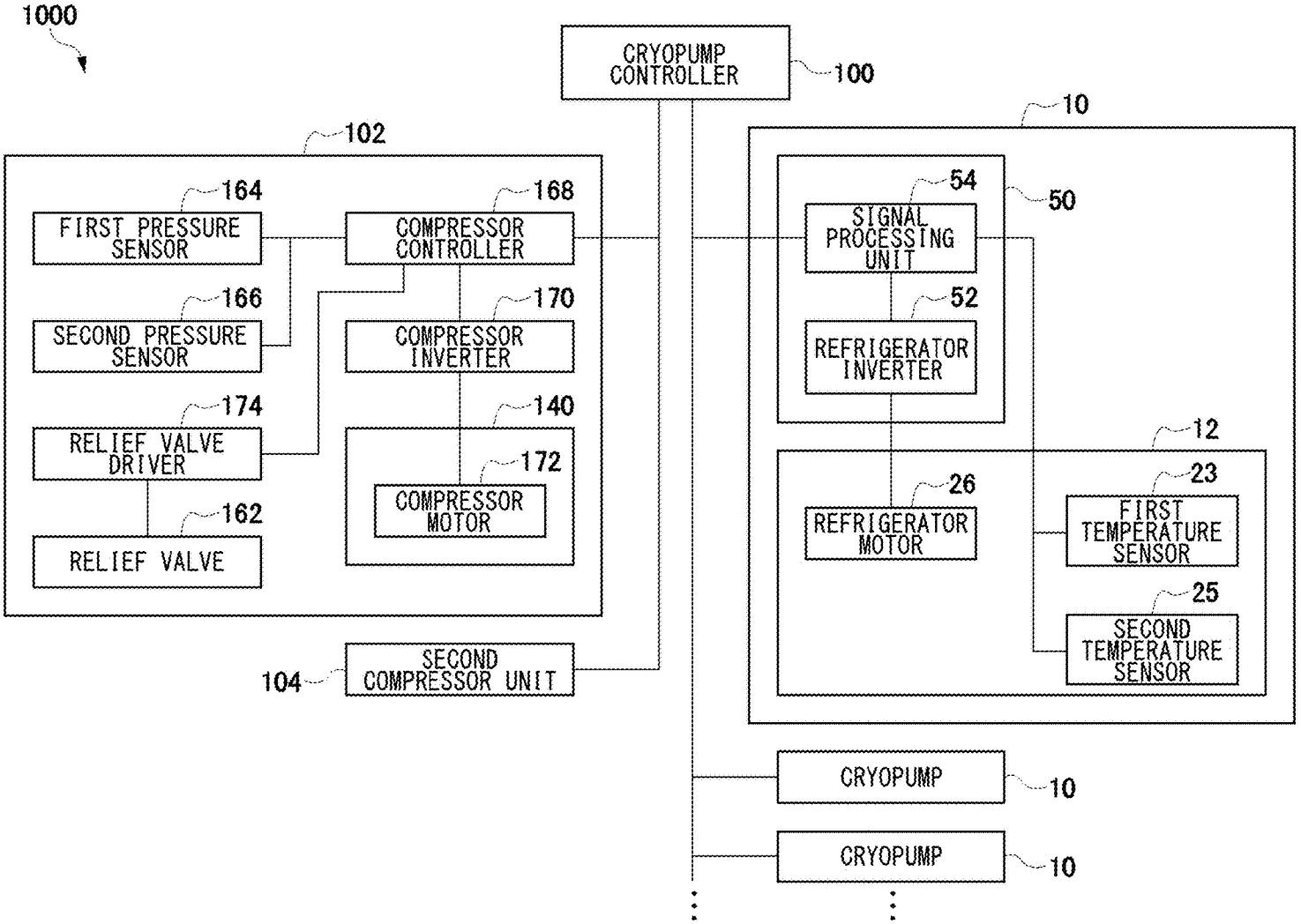
FIG. 4 shows a control block diagram with respect to a cryopump system according to the exemplary embodiment.

FIG. 4 shows a control block diagram with respect to the cryopump system 1000 according to the exemplary embodiment. FIG. 4 shows a main part of the cryopump system 1000 with respect to an exemplary embodiment of the present invention. One of the plurality of cryopumps 10 is shown in detail while illustrations for other cryopumps 10 are omitted since they are configured in a similar manner. Likewise, the first compressor unit 102 is shown in detail, while the illustration for the second compressor unit 104 is omitted since the second compressor unit 104 is configured in a similar manner.

As described above, the CP controller 100 is communicably connected to the I/O modules 50 of respective cryopumps 10. The I/O module 50 includes a refrigerator inverter 52 and a signal processing unit 54. The refrigerator inverter 52 adjusts power of prescribed voltage and frequency supplied from an external power source (e.g., commercial power) and supplies the power to the refrigerator motor 26. The voltage and the frequency of the power to be supplied to the refrigerator motor 26 are controlled by the CP controller 100.

The CP controller 100 determines a control amount based on a sensor output signal. The signal processing unit 54 passes the control amount transmitted from the CP controller 100 to the refrigerator inverter 52. For example, the signal processing unit 54 converts the control signal from the CP controller 100 into a signal that can be processed by the refrigerator inverter 52 and transmits the converted signal to the refrigerator inverter 52. The control signal includes a signal indicating the operating frequency of the refrigerator motor 26. The signal processing unit 54 passes an output from various sensors of the cryopump 10 to the CP controller 100. For example, the signal processing unit 54 converts a sensor output signal into a signal that can be processed by the CP controller 100 and transmits the converted signal to the CP controller 100.

Various sensors including the first temperature sensor 23 and the second temperature sensor 25 are connected to the signal processing unit 54 of the I/O module 50. As described above, the first temperature sensor 23 measures the temperature of the first cooling stage 22 of the refrigerator 12 and the second temperature sensor 25 measures the temperature of the second cooling stage 24 of the refrigerator 12. The first temperature sensor 23 and the second temperature sensor 25 periodically measures the temperature of the first cooling stage 22 and the second cooling stage 24, respectively, and output signals indicating the measured temperatures. The values measured by the first temperature sensor 23 and the second temperature sensor 25 are input to the CP controller 100 at predetermined time intervals, and are stored and retained in a predetermined storage region of the CP controller 100, accordingly.

The CP controller 100 controls the refrigerator 12 on the basis of the temperature of the cryopanel. The CP controller 100 provides an operation instruction to the refrigerator 12 so that an actual temperature of the cryopanel follows a target temperature. For example, the CP controller 100 controls the operating frequency of the refrigerator motor 26 by feedback control so as to minimize the deviation between the target temperature of the first stage cryopanel and the measured temperature of the first temperature sensor 23. The frequency of the heat cycle of the refrigerator 12 is determined in accordance with the operating frequency of the refrigerator motor 26. The target temperature of the first stage cryopanel is determined for example as a specification in accordance with a process performed in the vacuum chamber 80. In this case, the second cooling stage 24 of the refrigerator 12 and the panel assembly 14 are cooled to a temperature determined by the specification of the refrigerator 12 and a heat load from the outside.

In case the measured temperature of the first temperature sensor 23 is higher than the target temperature, the CP controller 100 outputs an instruction value to the I/O module 50 so as to increase the operating frequency of the refrigerator motor 26. In conjunction with the increase in the operating frequency of the motor, the frequency of the heat cycle in the refrigerator 12 is also increased, and the first cooling stage 22 of the refrigerator 12 is cooled to the target temperature. Meanwhile, in case a measured temperature of the first temperature sensor 23 is lower than the target temperature, the operating frequency of the refrigerator motor 26 is decreased and the temperature of the first cooling stage 22 of the refrigerator 12 is raised to the target temperature.

Under normal conditions, the target temperature of the first cooling stage 22 is defined as a constant value. Thus, the CP controller 100 outputs an instruction value so that the operating frequency of the refrigerator motor 26 is increased when a heat load on the cryopump 10 is increased, and outputs an instruction value so that the operating frequency of the refrigerator motor 26 is decreased when the heat load on the cryopump 10 is decreased. The target temperature may be varied as appropriate. For example, the target temperature of the cryopanel may be defined sequentially so that a targeted ambient pressure is realized in a given volume, which is to be pumped. The CP controller 100 may control the operating frequency of the refrigerator motor 26 so that the actual temperature of the second cryopanel is in agreement with a target temperature.

At a typical cryopump, the frequency of heat cycle is set as a constant value at any given time. The cryopump is set to operate with a relatively high frequency so as to permit a rapid cooling from a room temperature to the operating temperature of the pump. In case a heat load from the outside is small, the temperature of a cryopanel is controlled by warming with a heater. Therefore, the power consumption is high. In contrast, since the heat cycle frequency is controlled in accordance with a heat load on the cryopump 10 according to the exemplary embodiment. Therefore, a cryopump with excellent energy saving performance can be implemented. In addition, it is not necessarily required to provide a heater, which also contributes to reduction of the power consumption.

The CP controller 100 is communicably connected to the compressor controller 168. The controller of the cryopump system 1000 according to an exemplary embodiment of the present invention is configured with a plurality of controllers including the CP controller 100 and the compressor controller 168. According to another exemplary embodiment, the controller of the cryopump system 1000 may be configured with one CP controller 100, and 10 modules may be provided in the compressor units 102 and 104 as a substitute for the compressor controllers 168. In this case, the IO module relays a control signal between the CP controller 100 and respective constituent elements of the compressor units 102 and 104.

The compressor controller 168 controls the first compressor unit 102 on the basis of a control signal from the CP controller 100, or controls the first compressor unit 102 independently from the CP controller 100. According to an exemplary embodiment, the compressor controller 168 receives a signal indicating various preset values from the CP controller 100 and controls the first compressor unit 102 by using the preset values. The compressor controller 168 determines a control amount on the basis of a sensor output signal. In a similar manner as with the CP controller 100, the compressor controller 168 comprises a CPU that executes various types of arithmetic computing processes, a ROM that stores various types of control programs, a RAM that is used as a work area for storing data or executing a program, an I/O interface, a memory, or the like.

The compressor controller 168 transmits a signal indicating the operating status of the first compressor unit 102 to the CP controller 100. The signal indicating the operating status includes, for example, measurement pressures of the first pressure sensor 164 and the second pressure sensor 166, an opening degree or a control current of the relief valve 162, the operating frequency of a compressor motor 172, or the like.

The first compressor unit 102 includes a compressor inverter 170 and the compressor motor 172. The compressor motor 172 is a motor, which allows the compressor main body 140 to operate and whose operating frequency is variable. The compressor motor 172 is provided in the compressor main body 140. In a similar manner with that of the refrigerator motor 26, various motors may be adopted as the compressor motor 172. The compressor controller 168 controls the compressor inverter 170. The compressor inverter 170 adjusts power of prescribed voltage and frequency supplied from an external power source (e.g., commercial power) and supplies the power to the compressor motor 172. The voltage and the frequency of the power to be supplied to the compressor motor 172 is determined by the compressor controller 168.

To the compressor controller 168 are connected various sensors including the first pressure sensor 164 and the second pressure sensor 166. As described above, the first pressure sensor 164 periodically measures the pressure of the return side of the compressor main body 140, and the second pressure sensor 166 periodically measures the pressure of the supply side of the compressor main body 140. The values measured by the first pressure sensor 164 and the second pressure sensor 166 are input to the compressor controller 168 at predetermined time intervals, and are stored and retained in a predetermined storage region of the compressor controller 168, accordingly.

The relief valve 162 described above is connected to the compressor controller 168. A relief valve driver 174 for driving the relief valve 162 is provided in association with the relief valve 162 and the relief valve driver 174 is connected to the compressor controller 168. The compressor controller 168 determines the opening degree of the relief valve 162, and provides a control signal indicating the opening degree to the relief valve driver 174. The relief valve driver 174 controls the relief valve 162 so that the valve is opened with the opening degree. In this way, the flow rate of refrigerant gas of the bypass mechanism 152 is controlled. The relief valve driver 174 may be built in the compressor controller 168.

The compressor controller 168 controls the compressor main body 140 so that the differential pressure between an inlet and an outlet of the first compressor unit 102 (Hereinafter, also referred to as a compressor differential pressure) is maintained to a target differential pressure. For example, the compressor controller 168 performs feedback control so as to keep the differential pressure between the inlet and the outlet of the first compressor unit 102 at a constant value. According to an exemplary embodiment, the compressor controller 168 calculates the compressor differential pressure from the measurement value of the first pressure sensor 164 and the second pressure sensor 166. The compressor controller 168 determines the operating frequency of the compressor motor 172 so that the compressor differential pressure agrees with the target value. The compressor controller 168 controls the compressor inverter 170 so as to achieve the operating frequency. The target value of the differential pressure may be changed during the execution of differential pressure stabilization control.

A differential pressure stabilization control process in the aforementioned manner realizes a further reduction of power consumption. In case a heat load on the cryopump 10 and the refrigerator 12 is low, the heat cycle frequency of the refrigerator 12 is decreased by the cryopanel temperature control described above. Accordingly, the amount of refrigerant gas required by the refrigerator 12 is reduced. In this case, a gas volume more than required can be delivered from the compressor unit 102. The differential pressure between the inlet and the outlet of the compressor unit 102 is expected to increase, accordingly. However, according to the exemplary embodiment, the operating frequency of the compressor motor 172 is controlled so as to maintain the compressor differential pressure to a constant value. In this case, the operating frequency of the compressor motor 172 is reduced so as to decrease the differential pressure to the target value. Therefore, the power consumption can be reduced in comparison with the case where a compressor is always operated at a constant operating frequency as with a typical cryopump.

Meanwhile, if a heat load on the cryopump 10 is increased, the operating frequency of the compressor motor 172 is increased so as to keep the compressor differential pressure to a constant value. Therefore, the amount of refrigerant gas supplied to the refrigerator 12 can be secured sufficiently, and thus the deviation of the temperature of the cryopanel from the target temperature, which results from the increase of a heat load, can be restricted to a minimum.

Particularly, in case that time windows for opening a valve to a high pressure side for intake of refrigerant gas overlap among a plurality of refrigerators 12, the total amount of required gas increases. For example, in case of operating a compressor simply with a constant supply rate, or in case that the supply pressure of a compressor is not sufficient, gas amount to be supplied for a refrigerator that opens a valve later is less than that provided for a refrigerator that opens a valve earlier. The difference in a gas amount to be supplied among a plurality of refrigerators 12 causes variation of cooling capability among the refrigerators 12. By performing differential pressure control, the flow rate of refrigerant gas supplied to the refrigerator 12 can be secured sufficiently in comparison to the aforementioned cases. The differential pressure control not only contributes to energy saving performance, but also reduces variations of cooling capability among a plurality of refrigerators 12.

Figure 5:
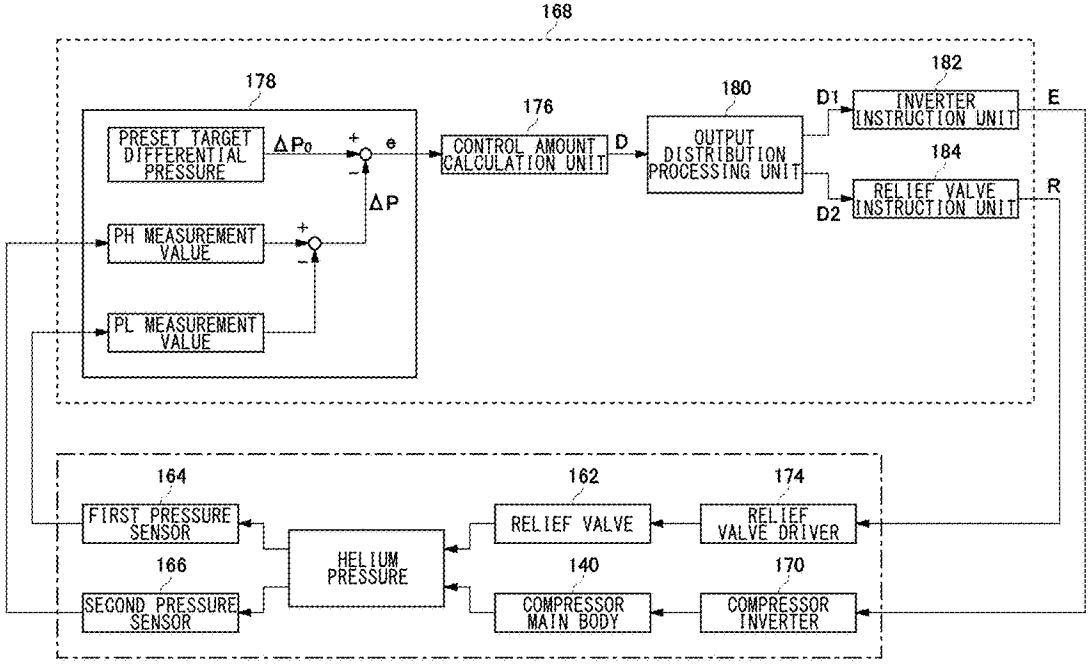
FIG. 5 is a diagram for illustrating a control flow of operation control of a compressor unit according to an exemplary embodiment of the present invention.

FIG. 5 is a diagram for illustrating a control flow of operation control of a compressor unit according to an exemplary embodiment of the present invention. The control process shown in FIG. 5 is executed by the compressor controller 168 repeatedly at predetermined time intervals during the operation of the cryopump 10. This process is executed by respective compressor controllers 168 of the respective compressor units 102 and 104, independently from other compressor units 102 and 104. In FIG. 5, a portion indicating arithmetic processing in the compressor controller 168 is partitioned by dashed lines, and a portion indicating hardware operation of the compressor units 102 and 104 is partitioned by alternate long and short dashed lines.

The compressor controller 168 comprises a control amount calculation unit 176. The control amount calculation unit 176 is configured so as to calculate, for example, at least a control amount for differential pressure stabilization control. According to the exemplary embodiment, the calculated control amount is divided and distributed to the opening degree of the relief valve 162 and to the operating frequency of a compressor motor 172 so as to perform the differential pressure stabilization control. According to another exemplary embodiment, only one of the operating frequency of a compressor motor 172 or the opening degree of the relief valve 162 may be set as a control amount so as to perform the differential pressure stabilization control. As will be described later, the control amount calculation unit 176 may be configured so as to calculate a control amount for at least one of the differential pressure stabilization control, the supply pressure control, or the return pressure control.

As shown in FIG. 5, a target differential pressure $\Delta P_0$ is defined for and input into the compressor controller 168 in advance. The target differential pressure is, for example, defined in the CP controller 100 and provided to the compressor controller 168. A measurement pressure PL of the return side is measured by the first pressure sensor 164, and a measurement pressure PH of the supply side is measured by the second pressure sensor 166. The measurement pressures are provided from respective sensors to the compressor controller 168. Under normal operating conditions, the measurement pressure PL of the first pressure sensor 164 is lower than the measurement pressure PH of the second pressure sensor 166.

The compressor controller 168 comprises a deviation calculation unit 178 that subtracts the return side measurement pressure PL from the supply side measurement pressure PH so as to calculate a measurement differential pressure $\Delta P$, and further calculates a differential pressure deviation e by subtracting the measurement differential pressure $\Delta P$ from a preset differential pressure $\Delta P_0$. The control amount calculation unit 176 of the compressor controller 168 calculates a control amount D from the differential pressure deviation e by a predetermined control amount arithmetic process including, for example, a PD calculation or a PID calculation.

As shown in the figure, the compressor controller 168 may comprise the deviation calculation unit 178 separately from the control amount calculation unit 176. Alternatively, the control amount calculation unit 176 may comprise the deviation calculation unit 178. Further, an integrating unit for accumulating the control amount D for a predetermined time period and providing the accumulated control amount D to the output distribution processing unit 180 may be provided after the control amount calculation unit 176.

The compressor controller 168 comprises the output distribution processing unit 180 that distributes the control amount D by dividing the control amount D into a control amount D1 to be provided for the compressor inverter 170 and a control amount D2 to be provided for the relief valve 162. According to an exemplary embodiment, the output distribution processing unit 180 may allocate most of the control amount D to the relief valve control amount D2 in case the control amount D is less than a predetermine threshold value. For example, the output distribution processing unit 180 may allocate a minimal portion of the control amount D required for the operation of the compressor to the inverter control amount D1 and may allocate all the rest of the control amount to the relief valve control amount D2. In case the control amount D is equal to or more than the threshold value thereof, the output distribution processing unit 180 may allocate all of the control amount D to the inverter control amount D1 (i.e., D=D1).

In this manner, in case the control amount D is relatively small, a pressure is released from the high pressure side to the low pressure side by controlling the relief valve 162 so as to adjust the compressor differential pressure to a desired value. Meanwhile, in case the control amount D is relatively large, the operation of the compressor is adjusted by an inverter control process so as to implement a required operation status. Instead of switching the inverter control and the relief valve control at a certain threshold value, the output distribution processing unit 180 may distribute the control amount D to both of the inverter control amount D1 and the relief valve control amount D2 in case the control amount D is at a middle range including the threshold value, or for all the range of the control amount D.

The compressor controller 168 comprises an inverter instruction unit 182 that calculates an instruction value E to be provided for the compressor inverter 170 on the basis of the inverter control amount D1, and a relief valve instruction unit 184 that calculates an instruction value R to be provided for the relief valve driver 174 on the basis of the relief valve control amount D2. The inverter instruction value E is provided to the compressor inverter 170, and the operating frequency of the compressor main body 140 (i.e., the compressor motor 172) is controlled in accordance with the instruction. The relief valve instruction value R is provided to the relief valve driver 174, and the opening degree of the relief valve 162 is controlled in accordance with the instruction. Based on operation statuses of the compressor main body 140 and the relief valve 162, and on the characteristic of relating pipe, tank, or the like, the pressure of helium, which is a refrigerant gas, is determined. The pressure of the helium determined in this manner is measured by the first pressure sensor 164 and the second pressure sensor 166.

In this way, the differential pressure stabilization control process is independently performed by respective compressor controllers 168 in the compressor units 102 and 104. The compressor controller 168 performs feedback control so as to minimize the differential pressure deviation e (preferably to zero). The compressor controller 168 performs the feedback control by switching modes between an inverter control mode wherein the operating frequency of the compressor is used as a variable to be controlled, and a relief valve control mode wherein the opening degree of the relief valve is used as a variable to be controlled, or by using the both modes in combination.

The deviation e shown in FIG. 5 is not limited to the deviation of the differential pressure. According to an exemplary embodiment, the compressor controller 168 may perform a supply pressure control process, which calculates a control amount from the deviation between the supply side measurement pressure PH and a preset pressure. In this case, the preset pressure may be the upper limit of the supply side pressure of the compressor. The compressor controller 168 may, in case the supply side measurement pressure PH exceeds this upper limit, calculate a control amount from the deviation between the supply side measurement pressure PH and the upper limit. The upper limit may be defined as appropriate either empirically or experimentally, for example, based on the maximum supply pressure of the compressor, which guarantees the vacuum pumping performance of the cryopump 10.

In this manner, an excessive increase of supply pressure can be restricted so that safety can be further improved. Therefore, the supply pressure control is an example of control for protection of a compressor unit.

According to an exemplary embodiment, the compressor controller 168 may perform a return pressure control process, which calculates a control amount from the deviation between the return side measurement pressure PL and a preset pressure. In this case, the preset pressure may be the lower limit of the return side pressure of the compressor. The compressor controller 168 may, in case the return side measurement pressure PL is less than this lower limit, calculate a control amount from the deviation between the return side measurement pressure PL and the lower limit. The lower limit may be defined as appropriate either empirically or experimentally, for example, based on the minimum return pressure of the compressor, which guarantees the vacuum pumping performance of the cryopump 10.

In this way, an excessive increase of temperature resulted from the decrease of the flow rate of refrigerant gas along with the decrease of return pressure can be restricted. In addition, in case of leakage from a piping system of refrigerant gas, the operation may be continued for a certain period while preventing an excessive decrease of pressure without immediately stopping the operation. Therefore, the return pressure control is an example of control for protection of a compressor unit.

Figure 6:
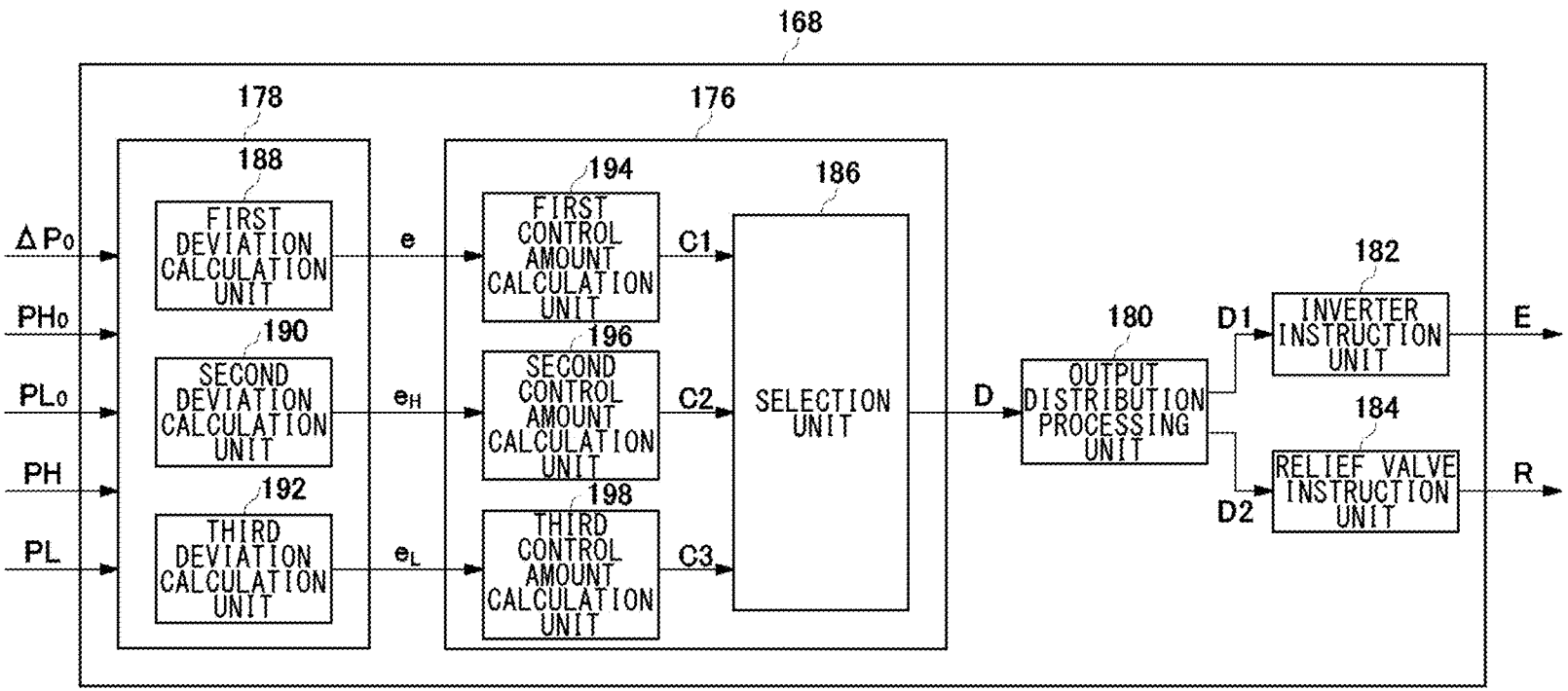
FIG. 6 is a diagram for illustrating a control flow of operation control of a compressor unit according to an exemplary embodiment of the present invention.

FIG. 6 is a diagram for illustrating a control flow of operation control of a compressor unit according to an exemplary embodiment of the present invention. The compressor controller 168 shown in FIG. 6 is configured to selectively perform a plurality of types of operation control of a compressor unit. For this purpose, the control amount calculation unit 176 comprises at least two calculation units and a selection unit 186 for selecting one control amount from a plurality of calculated control amounts. Other constituent elements of the compressor controller 168 are basically configured in a similar manner as the configuration shown in FIG. 5.

As shown in FIG. 6, the compressor controller 168 is configured to select for each control period one type of control from the differential pressure stabilization control, the supply pressure control, and the return pressure control on the basis of a measurement pressure, and is configured to perform the selected control. Under normal conditions, the compressor controller 168 performs the differential pressure stabilization control. In other words, the differential pressure stabilization control is selected as a default setting for the compressor controller 168. The supply pressure control and the return pressure control are defined as control for protection, and one of the two types of control is selected and performed as necessary.

The deviation calculation unit 178 of the compressor controller 168 receives inputs of a target differential pressure $\Delta P_0$, a supply side pressure upper limit $PH_0$, a return side pressure lower limit $PL_0$, a supply side measurement pressure PH, and a return side measurement pressure PL. As described above, the target differential pressure $\Delta P_0$, the supply side pressure upper limit $PH_0$, and the return side pressure lower limit $PL_0$ are predefined values.

The deviation calculation unit 178 comprises a first deviation calculation unit 188, a second deviation calculation unit 190, and a third deviation calculation unit 192. The first deviation calculation unit 188 calculates a differential pressure deviation e from the target differential pressure $\Delta P_0$, the supply side measurement pressure PH, and the return side measurement pressure PL. The second deviation calculation unit 190 subtracts the supply side measurement pressure PH from the supply side pressure upper limit $PH_0$ so as to calculate a supply differential pressure deviation $e_H$ ($=PH_0-PH$). The third deviation calculation unit 192 subtracts the return side measurement pressure PL from the return side pressure lower limit $PL_0$ so as to calculate a return differential pressure deviation $e_L$ ($=PL_0-PL$).

The control amount calculation unit 176 is configured so as to calculate control amounts for respective operation control in parallel. For this purpose, the control amount calculation unit 176 comprises a first control amount calculation unit 194, a second control amount calculation unit 196, and a third control amount calculation unit 198. The first control amount calculation unit 194 calculates a control amount in case of performing the differential pressure stabilization control from the differential pressure deviation e. Hereinafter, this control amount may also be referred to as a first control amount C1. The second control amount calculation unit 196 calculates a control amount in case of performing the supply pressure control from the supply differential pressure deviation $e_H$. Hereinafter, this control amount may also be referred to as a second control amount C2. The third control amount calculation unit 198 calculates a control amount in case of performing the return pressure control from the return differential pressure deviation $e_L$. Hereinafter, this control amount may also be referred to as a third control amount C3.

All of the first control amount C1, the second control amount C2, and the third control amount C3 are common control amounts calculated in order to control a same constituent element in the compressor units 102 and 104. More specifically, the control amounts C1, C2, and C3 are common control amounts for controlling the compressor motor 172 and/or the relief valve 162. The control amounts C1, C2, and C3 are adjusted so that power outputs from the compressor units 102 and 104 are increased or decreased in conjunction with the magnitude of the control amount values. That is, when the control amounts C1, C2, and C3 are large, the compressor units 102 and 104 are in a high-power operation. Conversely, when the control amounts C1, C2, and C3 are small, the compressor units 102 and 104 are in a low-power operation.

Therefore, the arithmetic computing process of the first control amount C1 is defined so that the control amount value is reduced (for example to a negative value) in case that a measurement differential pressure is larger than a target differential pressure (i.e., in case the differential pressure deviation e is negative), and is conversely defined so that the control amount value is increased (for example to a positive value) in case that a measurement differential pressure is smaller than the target differential pressure (i.e., in case the differential pressure deviation e is positive). In a similar manner, the arithmetic computing process of the second control amount C2 is defined so that the control amount value is reduced (for example to a negative value) in case that a measurement value is larger than a target value (i.e., in case the supply differential pressure deviation $e_H$ is negative), and is conversely defined so that the control amount value is increased (for example to a positive value) in case that a measurement value is smaller than the target value (i.e., in case the supply differential pressure deviation $e_H$ is positive).

The third control amount C3 may be defined as a value, which is a sign inverted (i.e., multiplied by −1) value of a value calculated from the return differential pressure deviation $e_L$ by predetermined arithmetic computing process of control amount including PD calculation or PID calculation. Therefore, the arithmetic computing process of the third control amount C3 is defined so that the control amount value is increased (for example to a positive value) in case that a measurement value is larger than a target value (i.e., in case the return differential pressure deviation $e_L$ is negative), and is conversely defined so that the control amount value is reduced (for example to a negative value) in case that a measurement value is smaller than the target value (i.e., in case the return differential pressure deviation $e_L$ is positive).

The first control amount C1, the second control amount C2, and the third control amount C3 are input to the selection unit 186. Smaller the value of a control amount is, lower the output from the compressor units 102 and 104 is, and lower the power consumption is. Therefore, the selection unit 186 selects the minimum value from the first control amount C1, the second control amount C2, and the third control amount C3 as a control amount D to be used in practice. By using the control amount D obtained in the aforementioned way, the compressor motor 172 and/or the relief valve 162 are controlled.

Figure 7:
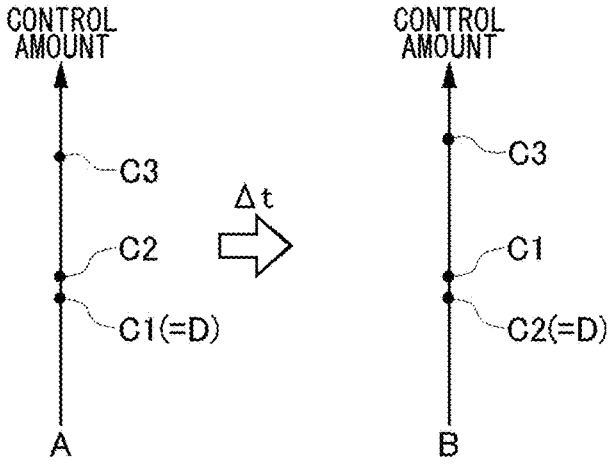
FIG. 7 relates to an exemplary embodiment of the present invention and schematically shows the change of control amounts.

FIG. 7 relates to an exemplary embodiment of the present invention and schematically shows the change of control amounts. Control amounts C1, C2, and C3 at a previous control time point A are shown on the left side of FIG. 7, and control amounts C1, C2, and C3 at a current control time point B are shown on the right side of FIG. 7. Extremely short time Δt, which corresponds to a control period, has been elapsed from the previous control time point A until the current control time point B.

At the previous control time point A, the third control amount C3 is the largest, the second control amount C2 is the second large, and the first control amount C1 is the smallest. The difference between the second control amount C2 and the first control amount C1 is extremely small. The third control amount C3 is considerably larger than the second control amount C2 and the first control amount C1. In this case, since the first control amount C1 is the smallest, the first control amount C1 is selected as a control value D to be output to the compressor units 102 and 104. Therefore, first operation control (e.g., the differential pressure stabilization control) is performed at the previous control time point A.

Since the control period Δt for the compressor controller 168 is generally extremely short time, changes in respective control amounts C1, C2, and C3 between the previous control time point A and the current control time point B are expected to be small. As shown in FIG. 7, at the current control time point B, the third control amount C3 continues to be the largest, the first control amount C1 is the second large, and the second control amount C2 is the smallest. The difference between the first control amount C1 and the second control amount C2 continues to be extremely small although the magnitude relation between the first control amount C1 and the second control amount C2 is changed.

In this case, since the second control amount C2 is the smallest, the second control amount C2 is selected as a control value D to be output to the compressor units 102 and 104. Second operation control (e.g., the supply pressure control) is performed at the current control time point B. That is, the operation control is switched from the first operation control to the second operation control. However, since the difference between the first control amount C1 and the second control amount C2 continues to be extremely small both at the previous control time point A and at the current control time point B, the change in the control amount D obtained as a result is extremely small.

In this manner, it is normally expected that one control amount value is slightly larger than the other immediately before a change in magnitude relation between two control amounts, and the one control amount value is slightly smaller than the other immediately after the change in magnitude relation. Therefore, the change in the control amount D when switching corresponding two types of operation control is small. Consequently, the change in operation status of the compressor units 102 and 104 is also small. Therefore, the operation of the compressor units 102 and 104 can be continued without significantly changing the flow rate of refrigerant gas in the cryopump system 1000, and particularly without significantly changing the temperature of cryopanels.

As described above, the cooling capability of the refrigerator can be improved without changing the design of the cryopump 10 in the cryopump system 1000 by increasing the enclosure pressure of the refrigerant gas in the compressor unit, or by increasing a predefined differential pressure value of the differential pressure stabilization control. However, such measures might lead to a departure during operation from a range of refrigerant gas pressure predefined as a specification of the compressor units 102 and the 104. Depending on circumstances, safeguard equipment built in the compressor units 102 and 104 might be activated and the compressor units 102 and 104 might be stopped automatically.

According to the exemplary embodiment, while performing the differential pressure stabilization control, if the supply side measurement pressure PH increases and surpasses the supply side pressure upper limit $PH_0$, the operation of the compressor unit is switched from the differential pressure stabilization control to the supply pressure control. If the supply side measurement pressure PH approaches the supply side pressure upper limit $PH_0$ by the supply pressure control, the operation of the compressor units 102 and 104 is switched back to the differential pressure stabilization control. In this manner, the operation of the compressor units 102 and 104 can be continued while the differential pressure stabilization control and the supply pressure control (or the return pressure control) is switched on as needed basis.

Therefore, according to the exemplary embodiment, the differential pressure stabilization control and the supply pressure control of the compressor units 102 and 104 is switched on as needed basis on condition that the minimum control amount is selected. Thereby, measures to improve the cooling capability of the cryopump 10 and operational continuity of the compressor units 102 and 104 with stability can become compatible. Further, the embodiment is also preferable in terms of less influence on energy saving performance.

As described above, the control amounts C1, C2, and C3 are adjusted so that the outputs from the compressor units 102 and 104 become high if the control amounts C1, C2, and C3 are large. Therefore, the selection of the control amount D by the selection unit 186 corresponds to a determination as to whether or not the differential pressure stabilization control puts a heavier load on the compressor units 102 and 104 than the supply pressure control (or the return pressure control). In other words, the selection of the control amount D by the selection unit 186 corresponds to a determination of operation control that minimizes the power consumption from a plurality of types of operation control of a compressor unit.

If it is determined that the differential pressure stabilization control puts a heavier load on the compressor units 102 and 104 than the supply pressure control, the compressor controller 168 temporarily changes the control of the compressor unit from the differential pressure stabilization control to the supply pressure control. If it is determined that the differential pressure stabilization control does not put a heavier load on the compressor units 102 and 104 than the supply pressure control, the compressor controller 168 continues the differential pressure stabilization control. According to the exemplary embodiment, such processes can be implemented by a simple measure, i.e., by selecting a minimum value from a plurality of control amounts. In this manner, the operation of the compressor units 102 and 104 can be continued while preventing the supply pressure control from applying an excessively high pressure to the compressor units 102 and 104.

By continuing the supply pressure control for a while, the operation statuses of the compressor units 102 and 104 are expected to settle in the status is more stabilized compared to the starting point of the supply pressure control. For example, a supply pressure of a value near the upper limit of safety zone according to the specification at the starting point of the supply pressure control is expected to decrease and to converge in the vicinity of a target value by continuing the supply pressure control for a certain period. At that time point, the necessity for protection has decreased already. In addition, the differential pressure stabilization may be capable of operating the compressor units 102 and 104 with less output than the supply pressure control at that time point.

Therefore, if it is determined during the supply pressure control that the supply pressure control puts a heavier load on the compressor units 102 and 104 than the differential pressure stabilization control, the compressor controller 168 returns the control of the compressor units 102 and 104 from the supply pressure control to the differential pressure stabilization control automatically. In this manner, the operation of the compressor units 102 and 104 can be continued while the power consumption is restricted to a relatively low level.

Given above is an explanation based on the exemplary embodiment. The exemplary embodiment described above is intended to be illustrative only and it will be obvious to those skilled in the art that various modifications could be developed and that such modifications are also within the scope of the present invention.

For example, the control unit may use an amount calculated by the control amount (e.g., the control amount D1 to be provided to the compressor inverter 170, the control amount D2 to be provided to the relief valve 162, the inverter instruction value E, the relief valve instruction value R, or the like) in order to evaluate a load on the compressor units applied by respective operation control, instead of the control amounts C1, C2, and C3 described above.

Further, the control unit may not necessarily use a control amount as an evaluation parameter for evaluating the operation status of a compressor unit. The evaluation parameter may be any parameters that reflect a load on the compressor unit under respective operation control, and may for example be a parameter exclusively used for comparison that indicates the deviation between a predefined value and a measurement value for each operation control.

The first operation control, which is normal control, is preferably control that is most superior in energy saving performance. In the exemplary embodiment described above, the differential pressure stabilization control is adopted as the first operation control. However, the normal operation is not limited thereto, and may be any operation control based on refrigerant gas pressure, such as, supply pressure control, return pressure control, or the like. Alternatively, the normal operation may be, for example, flow control that directly controls the flow rate of refrigerant gas. In case of adopting the flow control, the cryogenic system or the compressor unit preferably provides a flow rate sensor for measuring the flow rate of refrigerant gas at the supply side and/or the return side of the compressor unit. In a similar manner with that of the normal operation, the protection control may be operation control based on the refrigerant gas pressure and/or may be flow control that directly controls the flow rate of refrigerant gas.

When the cryogenic system is in a specific state (e.g., regeneration of a cryopump, or start up of the system) that is different from the normal state, only the normal control may be performed and the protection control may not be performed in the compressor unit. In this case, in that specific state, the control unit may suspend calculations relating to the protection control. By suspending calculations, a computing load can be reduced.

The control unit may perform the computation relating to the protection control during a required period instead of always performing the computation. For example, in a situation wherein an evaluation parameter for operation control that is currently selected and an evaluation parameter for different operation control are expected to come close to each other, the control unit may calculate the evaluation parameter for the different operation control.

In the exemplary embodiment described above, the control unit set as a condition for switching control that control amount is the minimum value, the condition for switching control is not limited thereto. For example, in case of putting a high priority on the protection of the compressor unit, the control unit may switch operation control of the compressor unit from the normal control to the protection control immediately when a refrigerant gas pressure surpasses a certain high pressure limit value. In this process, in case of putting a high priority on the variation suppression in operation status, the control unit may switch the operation control of the compressor unit from the normal control to the protection control immediately on condition that an evaluation parameter of the normal control and an evaluation parameter of the protection control are close to each other.

In this way, additional (or alternative) condition may be predefined in the control unit upon selecting operation control. In case that such an additional condition is satisfied, the control unit may select operation control different from operation control that is selected by a main condition (e.g., the operation control that provides the minimum control amount according to the exemplary embodiment described above). As described above, an additional condition may be determined in order to facilitate the protection of a compressor unit, and may include, for example, a surplus of refrigerant gas pressure over a certain high pressure limit value. In case of putting a high priority on the variation suppression in operation status, the additional condition may further include that an evaluation parameter of the normal control and an evaluation parameter of the protection control are close to each other (e.g., the two evaluation parameters are included in a predefined range).

It should be understood that the invention is not limited to the above-described embodiment, but may be modified into various forms on the basis of the spirit of the invention. Additionally, the modifications are included in the scope of the invention.

Priority is claimed to Japanese Patent Application No. 2011-285356, filed on Dec. 27, 2011, the entire content of which is incorporated herein by reference.

What is claimed is:

1. A cryopump system comprising:

a cryopump comprising a cryopanel and a refrigerator operative to cool the cryopanel;

a compressor unit operative to supply refrigerant gas to the refrigerator; and a control unit configured to selectively perform one of at least two types of operation control for the compressor unit, the at least two types of operation control including (a) differential pressure control that operates the compressor unit by using a control amount so as to control a differential pressure between a supply side pressure and a return side pressure of the compressor unit and (b) supply pressure control that operates the compressor unit by using the control amount so as to control the supply side pressure of the compressor unit, wherein the control unit comprises a first control amount calculation unit configured to calculate, at predetermined time intervals, a first value of the control amount based on a first deviation between a measured value of the differential pressure and a preset target value of the differential pressure, a second control amount calculation unit configured to calculate, at the same predetermined time intervals and in parallel with calculation of the first value of the control amount by the first control amount calculation unit, a second value of the control amount based on a second deviation between a measured value of the supply side pressure and a preset target value of the supply side pressure, and a selection unit configured to select, for each predetermined time interval, either the first value or the second value of the control amount based on a direct comparison between the first value and the second value of the control amount, wherein the control unit is configured to control the compressor unit by using the selected value of the control amount.

2. The cryopump system according to claim 1, wherein the selection unit is configured to select either the first value or the second value of the control amount in response to a change of magnitude relation between the first value and the second value of the control amount.

3. The cryopump system according to claim 1, wherein the at least two types of operation control further includes (c) return pressure control that operates the compressor unit by using the control amount so as to control the return side pressure of the compressor unit, wherein the control unit further comprises a third control amount calculation unit configured to calculate a third value of the control amount based on a third deviation between a measured value of the return side pressure and a preset target value of the return side pressure, wherein the selection unit is configured to select either the first value, the second value, or the third value of the control amount based on a comparison between the first value, the second value, and the third value of the control amount.

* * * * *